US006039223A

United States Patent [19]

Damask

[11] Patent Number: 6,039,223

[45] Date of Patent: Mar. 21, 2000

[54] BULK LOAD DISPENSER AND METHOD

[76] Inventor: John E. Damask, 5204 Springdale Dr., McHenry, Ill. 60050

[21] Appl. No.: 09/178,008

[22] Filed: Oct. 23, 1998

[51] Int. Cl.[7] ..... B67D 5/42

[52] U.S. Cl. ..... 222/389; 222/399; 222/175; 222/527

[58] Field of Search ..... 222/389, 399, 222/175, 527, 61

[56] References Cited

U.S. PATENT DOCUMENTS

| | | | |
|---|---|---|---|
| 1,974,849 | 9/1934 | Harris | 222/175 |
| 3,254,806 | 6/1966 | Madsen | 222/389 X |
| 3,980,209 | 9/1976 | Collar . | |
| 3,983,947 | 10/1976 | Wills et al. . | |
| 4,153,180 | 5/1979 | Fernique | 222/61 X |
| 4,376,498 | 3/1983 | Davis, Jr. . | |
| 4,570,832 | 2/1986 | Kroger . | |
| 5,181,636 | 1/1993 | Anderson et al. . | |
| 5,184,758 | 2/1993 | Keller . | |
| 5,188,259 | 2/1993 | Petit | 222/175 X |
| 5,203,839 | 4/1993 | Skaggs . | |
| 5,224,629 | 7/1993 | Hsich . | |
| 5,385,274 | 1/1995 | Twyman . | |
| 5,441,175 | 8/1995 | Jacobsen et al. . | |
| 5,458,275 | 10/1995 | Centea et al. . | |
| 5,535,926 | 7/1996 | Blitz et al. . | |
| 5,553,754 | 9/1996 | Dentler . | |
| 5,573,148 | 11/1996 | Poole et al. . | |
| 5,579,960 | 12/1996 | Scott . | |
| 5,674,337 | 10/1997 | Coombs et al. . | |

*Primary Examiner*—Joseph A. Kaufman
*Assistant Examiner*—Thach Bui
*Attorney, Agent, or Firm*—Mathew R. P. Perrone, Jr.

[57] ABSTRACT

A pneumatically powered caulking device, also known as a powered bulk load dispenser, has a frame supporting a tubular housing, with a driving assembly mounted at one end of the tubular housing and application hose mounted at an opposing end of the tubular housing, and is used to apply a large amount of caulking material.

17 Claims, 3 Drawing Sheets

Fig.5.
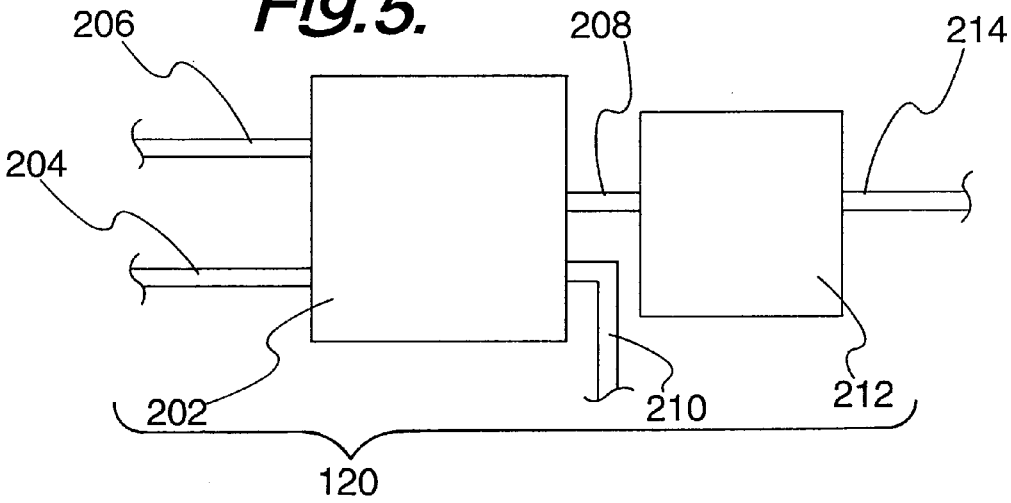
Fig.6.
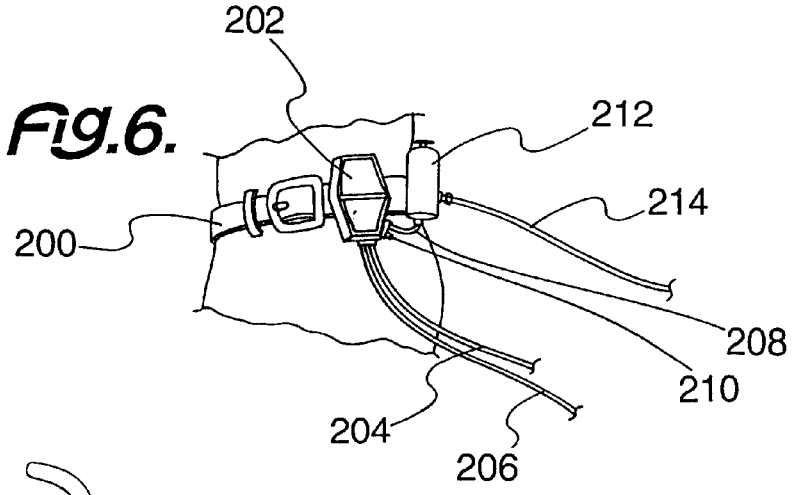
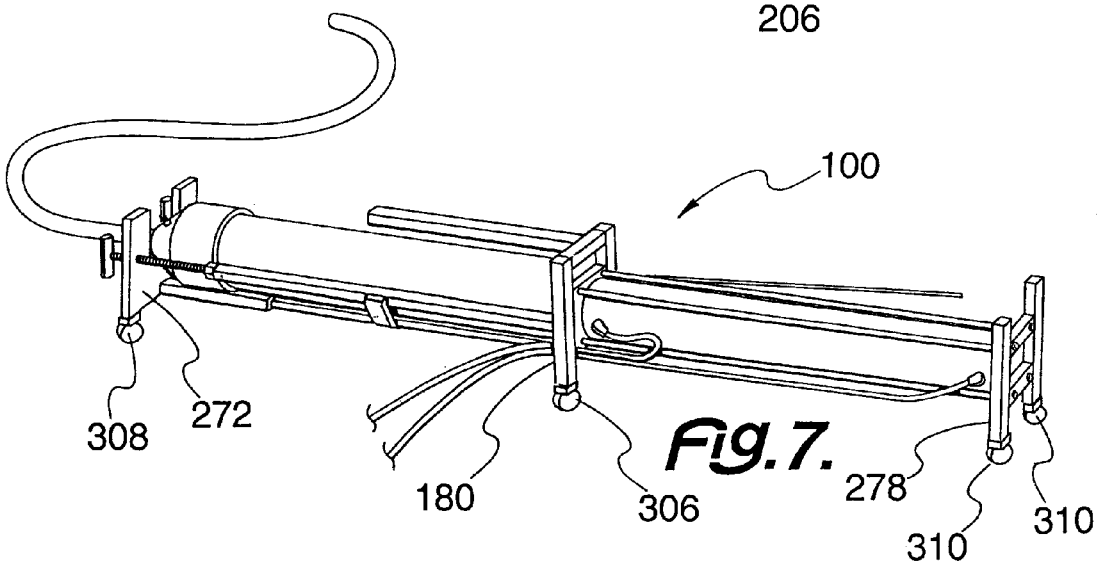
Fig.7.

BULK LOAD DISPENSER AND METHOD

This invention relates to a caulking device and more particular to a power, operated caulking device or bulk load dispenser, capable of providing an efficient method for applying caulk.

BACKGROUND OF THE INVENTION

An efficient caulking procedure has very great utility in the construction fields. Two of those functions are utilitarian and decorative. With the application of a caulking compound, undesired air flow can be blocked. Rough support surfaces can be given a smooth appearance. So application of a caulk to a surface has both utilitarian and decorative functions.

Throughout this application, caulk and caulking compound may be used interchangeably. A utilitarian function is one which serves a practical, sometimes comfort supporting situation. For example, caulk sealing around the edge of a window in building can enhance heating and cooling thereof by preventing undesired air flow from the outside, or by keeping heated or cooled air inside. A decorative function has, as its primary purpose, improving the aesthetic appearance of a surface. Clearly, the decorative and utilitarian functions can overlap.

The application of caulk to any surface does require great skill. One must apply the right amount of caulk, in the right place at the right time. Whether the application is for decorative or utilitarian purposes, such application requires great skill. The desire to simplify this procedure is great.

The difficulty in simplification of the caulking process is that the automation of the caulking gun must not adversely affect flexibility in the application by and use of the caulking gun, while providing for the efficient caulking or applying of the material in a desired amount to the desired surface. If all of these steps cannot be accomplished in a highly coordinated fashion, the caulking of the desired surface will be inefficient, and the caulking device will lose its great advantage.

Another disadvantage of the caulking gun is that there is a limited amount of caulk that may be applied. Such a limitation comes from the limited size of the caulking gun, the corresponding limited amount of caulk contained therein, and the fatigue generated by the hand operation of the caulking gun.

Furthermore, the caulking requires a highly skilled person, especially in order to achieve both a decorative and utilitarian function. If the skilled person can be replaced, by a semi-skilled person, great advantages can be obtained. It will thus be easier to find a person to do the job, as semi-skilled persons are more numerous than skilled persons.

This limited amount of caulk that can be applied makes a difficult job longer and much less efficient. The standard hand caulking gun has a limited caulk containing capacity. Not only is it fatigue inducing, it takes time to stop and reload the caulking gun.

Currently known attempts at automating the caulking procedure are cumbersome. Such standard automated devices are either too heavy or lack flexibility. They also lack maneuverability. Large capacity for a caulking compound mitigates against maneuverability and flexibility for the caulk applying device. Maneuverability and flexibility for the caulk applying device prohibit a large capacity for the caulking compound.

Also, large capacity, automated caulking devices are difficult to manufacture. Therefore, such a device is expensive. Such expense results in a great disadvantage for using the automated caulking device. Cost reduction becomes a critical factor in the manufacture of an power operated caulking device.

If a device can be found for applying a greater amount of caulk, more quickly and more efficiently, the advantages become tremendous. The reductions in time and more efficient use of material contribute greatly thereto.

However, if an automated caulking device can compensate for these contraindicated functions, the desired results with efficient may be obtained in an efficient matter. It is, nevertheless, difficult to maximize the advantages of an automated caulking device, while, at the same time, maintaining the flexibility of the hand caulking gun.

SUMMARY OF THE INVENTION

Among the many objectives of this invention is the provision of a power operated bulk load dispenser.

A further objective of this invention is the provision of an inexpensive tubular housing for a pneumatically operated caulking device.

A still further objective of this invention is the provision of a power operated caulking device with increased storage capacity.

Yet a further objective of this invention is the provision of a power operated caulking device with increased flexibility.

Also an objective of this invention is the provision of a power operated caulking device with increased maneuverability.

Another objective of this invention is the provision of a power operated caulking device to permit caulking by a semi-skilled person as opposed to a skilled person.

Yet another objective of this invention is the provision of a power operated caulking device to permit application of utilitarian caulk more simply.

Still another objective of this invention is the provision of a power operated caulking device to permit application of decorative caulk more simply.

A further objective of this invention is the provision of an inexpensive tubular housing for a pneumatically operated bulk load dispenser.

A still further objective of this invention is the provision of a power operated bulk load dispenser with increased storage capacity.

Yet a further objective of this invention is the provision of a power operated bulk load dispenser with increased flexibility.

Also an objective of this invention is the provision of a power operated bulk load dispenser with increased maneuverability.

Another objective of this invention is the provision of a power operated bulk load dispenser to permit caulking by a semi-skilled person as opposed to a skilled person.

Yet another objective of this invention is the provision of a power operated bulk load dispenser to permit application of utilitarian caulk more simply.

Still another objective of this invention is the provision of a power operated bulk load dispenser to permit application of decorative caulk more simply.

A further objective of this invention is the provision of a method for applying a large amount of caulking material.

A still further objective of this invention is the provision of a power operated method for a applying a large amount of caulk.

Yet a further objective of this invention is the provision of a method for power application of caulk with increased mobility.

These and other objectives of the invention (which other objectives become clear by consideration of the specification, claims and drawings as a whole) are met by providing a powered bulk load dispenser, having a frame supporting a tubular housing, with a driving assembly mounted at one end of the tubular housing and application hose mounted at an opposing end of the tubular housing, and method for applying a large amount of caulking material.

BRIEF DESCRIPTION OF DRAWINGS

FIG. 5 depicts a block diagram of valve assembly 120 for controlling the bulk load dispenser 100 as shown in FIG. 4.

FIG. 6 depicts a suggested structure for FIG. 5 for valve assembly 120 for controlling the bulk load dispenser 100 as shown in FIG. 4.

FIG. 7 depicts a perspective view of the bulk load dispenser 100 of this invention having a castor assembly 300, mounted thereon.

Throughout the figures of the drawings where the same part appears in more than one figure, the same number is applied thereto.

DESCRIPTION OF PREFERRED EMBODIMENTS

Figure 1:
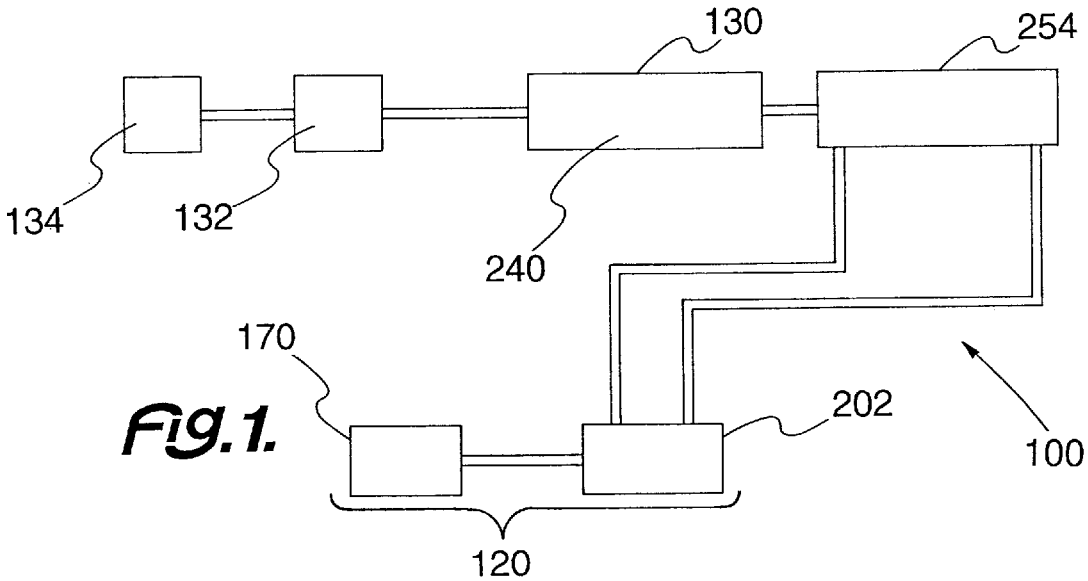
FIG. 1 depicts a block diagram of the bulk load dispenser 100 of this invention.

The bulk load dispenser of this invention is handled by an operator. For the bulk load dispenser (or pneumatically powered caulking device), a tubular housing is mounted in a frame and connected pneumatically to a four-way valve. Plastic pneumatic lines connect the four-way valve to a pneumatic driving assembly, which cooperates with the tubular housing. The four-way valve permits material to be delivered from the tubular housing to the material delivery hose, by directing air pressure to the drive assembly. At one end of the tubular housing is a reducing cap. A dispensing hose for the caulk is attached to the dispensing cap at a point oppositely disposed from the tubular housing.

The tubular housing is preferably a cylinder, which may, in turn, be formed of standard polyvinyl chloride pipe. There is a holding restraint and carrying handle as a part of a frame. This frame, which supports the tubular housing, permits the bulk load dispenser to be carried easily, and maneuvered efficiently.

For the housing, a standard polyvinyl chloride pipe may be used. While any other material may used for the housing, the polyvinyl chloride pipe is the most economically efficient. It also has the desired strength and durability for the bulk load dispenser.

A reducing cap is applied to one end of the polyvinyl chloride pipe. The reducing cap has an open end adapted to receive the polyvinyl chloride pipe. Usually oppositely disposed from open end of the reducing cap is conical end. The conical end includes a narrowed opening with a nipple.

At the nipple, the caulking hose is secured. From the nipple, the caulking hose runs and can be used to apply the material. The caulking hose runs from the nipple and directs the caulk to the desired surface. The reaction plate secures the top of the reducer and hence the nipple to the frame. On the reducing cap is a bleeder valve, which can be used to release the vacuum on the cylinder or tubular housing for the ease of disassembling and refilling.

At the other end of the tubular housing is a driving assembly. The driving assembly includes a piston assembly and a rod assembly. The piston assembly includes a piston pad which is bolted to a top plate, the top plate is bolted to a bearing pad and the base plate is secured to the rod assembly. Thus, the piston pad bolt secures the top plate to a bearing pad and the barbell shaped pad assembly. The piston assembly slides within the polyvinyl chloride pipe and permits the expulsion of the material within the supply tube, through the caulking hose.

The driving assembly for the piston includes a rod assembly with a following rod plate and a base plate. The base plate supports the following rod plate and the pneumatically powered piston forces an extending cylinder rod to contact the piston and drive the material out of the base. The preferred supply tube for device is formed of the standard polyvinyl chloride pipe. To assemble the polyvinyl chloride pipe with the piston assembly, an extended bolt runs through the reaction plate and down to the frame assembly base.

Within the frame assembly are four supporting rods which support the cylinder in place. The reaction plate includes a plate rod extending to the base rod which extends from the base plate. The frame assembly is formed by bolting, welding or otherwise securing the parts thereof in the desired relationship. In this fashion, the polyvinyl chloride pipe can be removably secured in the frame assembly. The central plate and the base plate support the air cylinder, which provides the rod to force the piston through the polyvinyl chloride pipe and dispense the caulking compound.

This bulk load dispenser includes a pipe or tube or cylinder. Preferably this pipe is about ten centimeters in diameter and forms a cylinder. The piston assembly used within the pipe is driven by the rod assembly through the pipe and applying the caulk to the desired surface. The caulk is loaded into the pipe above the piston assembly by removal of the cap.

The top frame of the bulk load dispenser preferably consists of thick metal plates (usually steel); the bottom plate is usually five centimeters thick; the middle plate is usually one to one and a half centimeters thick and the top plate is usually about six-tenths of a centimeter thick. The bearing pad is designed on the plate to fit the four inch pipe. The rod center runs through the pipe. The base pipe for the tube and supports the caulk at the appropriate point. The air frame is connected to the feed by the appropriate tubing and air source.

As the air proceeds in the air cylinder and drives the rod assembly and hence the piston assembly, the caulk is forced out of the cylinder. The four way valve controls the air pressure, which forces the piston to contact the caulking compound. The bleeder valve permits the vacuum to be released from the tube and the cap to be removed. The automatic bulk load dispenser can then be reversed in a simple fashion. With the release of the air pressure, the reducing cap may be removed from the cylinder, before cleaning, reloading or other suitable purpose.

In the block diagram of FIG. 1, which depicts a block diagram of the bulk load dispenser 100 of this invention, the four way valve 202 is connected to the air cylinder 254, which powers or drives caulk out of cylinder 130. Within the supply cylinder 130 is mounted the piston assembly 240. With four-way valve 202 also connected to an air supply 170, the four-way valve 202, feeds air from air supply 170 to air cylinder 254. Air into air cylinder 254 can drive piston assembly 240 into supply cylinder 130 below piston assembly 240, so that caulk may be forced into supply cap 132 and then into caulking hose 134, for caulk application.

Figure 2:
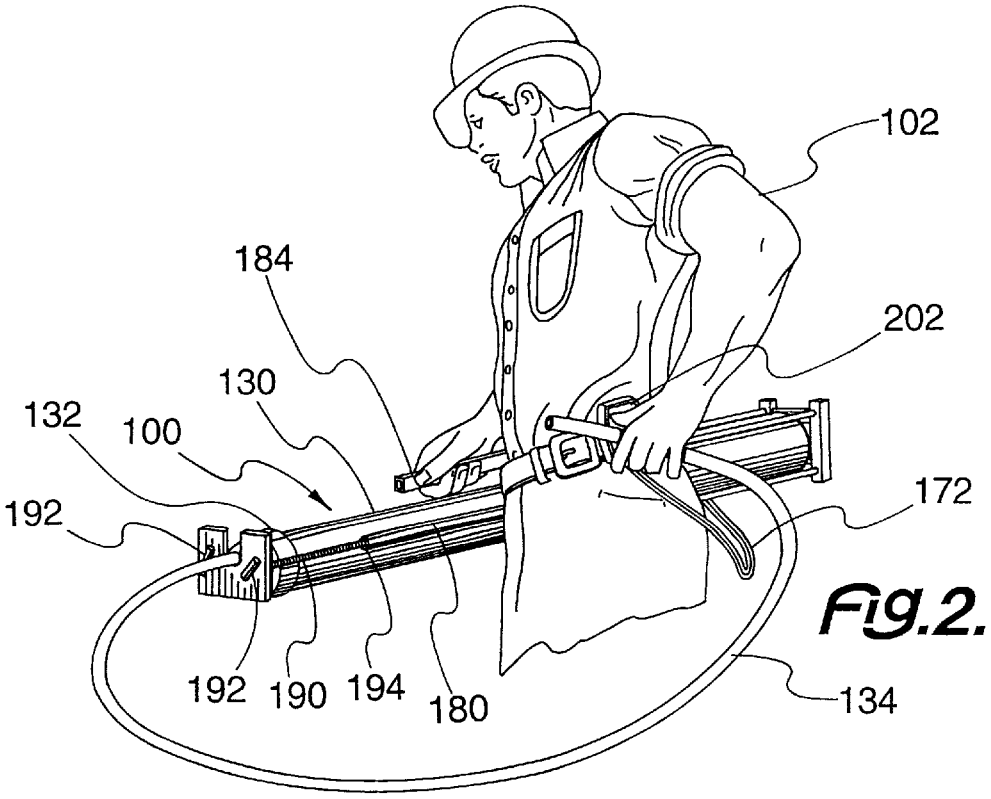
FIG. 2 depicts a perspective view of the bulk load dispenser 100 of this invention in use.

Adding FIG. 2 to the consideration, bulk load dispenser 100 of this invention is handled by an operator 102. For the bulk load dispenser 100, a tubular housing or the supply cylinder 130 is mounted in a frame assembly 180 and connected by air hoses 172 to supply cylinder 130 and four-way valve 202. Extending from frame assembly 180 is caulking hose 134.

Figure 3:
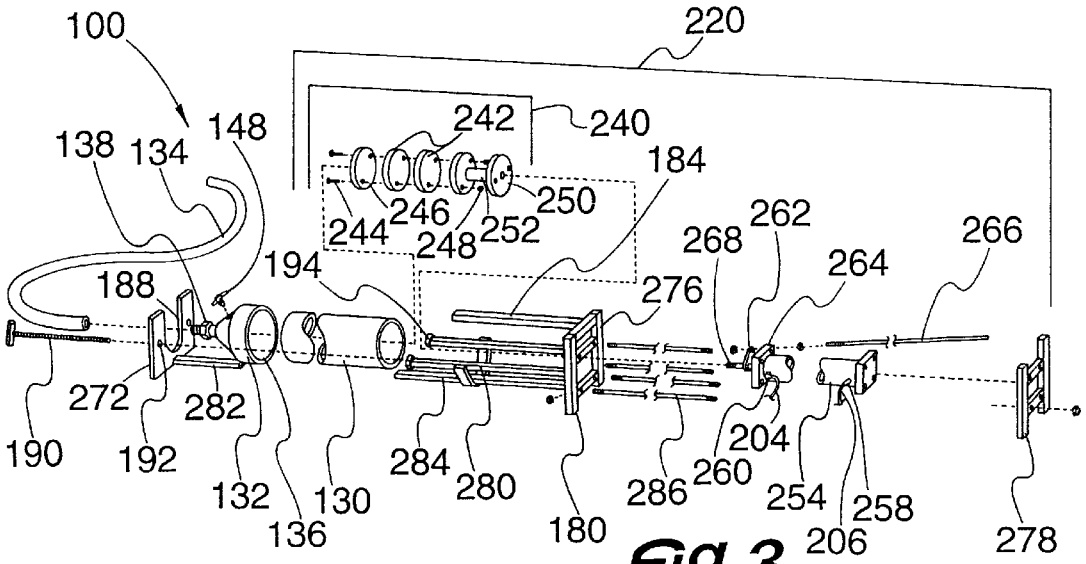
FIG. 3 depicts a perspective view of the bulk load dispenser 100 of this invention.
Figure 4:
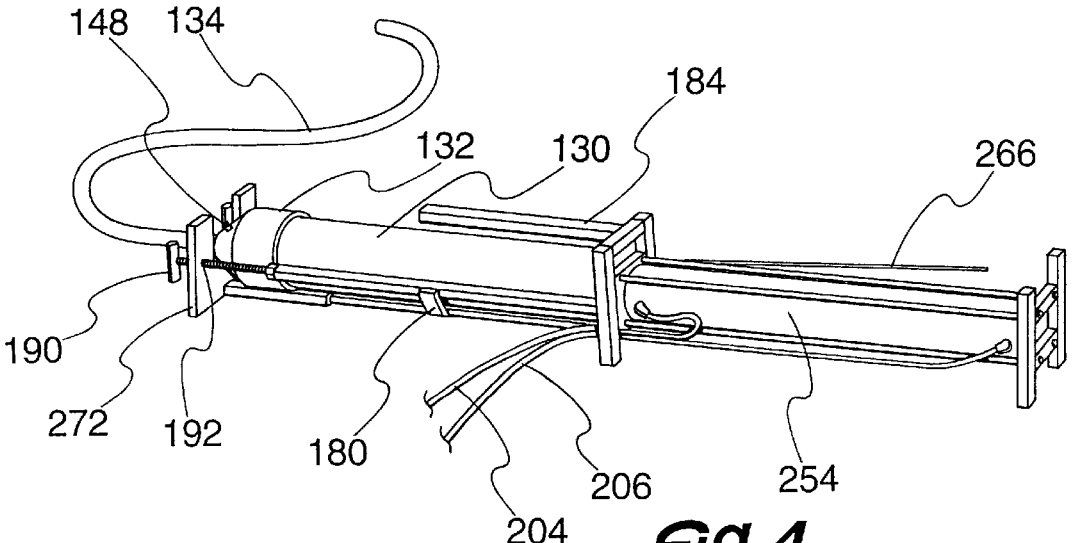
FIG. 4 depicts an exploded, perspective view of the bulk load dispenser 100 of this invention.

Adding FIG. 3 and FIG. 4 to the consideration, the bulk load dispenser 100, the supply cylinder 130 is mounted in frame assembly 180. At one end of the supply cylinder 130 is a reducing or supply cap 132. A dispensing or caulking hose 134 for the caulk is attached to the dispensing or supply cap 132 at a point oppositely disposed from the supply cylinder 130.

The supply cylinder 130 is preferably a tubular member, which may, in turn, be formed of standard polyvinyl chloride pipe. There are a reaction plate 272 and a carrying handle 184 as a part of a frame assembly 180. This frame assembly 180, which supports the supply cylinder 130, permits the bulk load dispenser 100 to be carried easily, and maneuvered efficiently.

On one end of the supply cylinder 130 is secured a reducing or supply cap 132. Supply cap 132 is secured at open enlarged end 136 of supply cap 132 to supply cylinder 130. Because of its somewhat conical shape supply cap 132 has a narrowed hose receiving outlet 138 adapted to receive one end of caulking hose 134. The hose receiving outlet 138 provides a nipple-like shape to the caulking hose 134. The caulking hose 134 can be used to apply the caulking material from supply cylinder 130.

On the reducing or supply cap 132 is a bleeder valve 148. This bleeder valve 148 can be used to release the vacuum on the supply cylinder 130. By releasing that vacuum, the bulk load dispenser 100 may be more easily disassembled, refilled and reassembled.

At the other end of the supply cylinder 130 oppositely disposed from the supply cap 132 is a driving assembly 220. The driving assembly 220 includes a piston assembly 240 and a air cylinder 254. The piston assembly 240 includes a piston packing pad 242, which has plate bolts 244 securing the piston pad 242 to top plate 246, with plate nuts 248. Additionally, plate bolts 244 secure base piston plate 250 to piston packing pad 242, thus securing one or more piston packing pads 242 between base piston plate 250 and top piston plate 246.

The base piston plate 250 is secured to the cylinder rod 268. Thus, the plate bolts 244 secure the top piston plate 246 to one or more piston packing pads 242 and the preferably barbell shaped base piston plate 250. The piston packing pads 242 are thus secured between top piston plate 246 and base piston plate 250. The piston assembly 240 slides within the supply cylinder 130 and permits the expulsion of the caulking material from the caulking hose 134.

The driving assembly 220 for the piston assembly 240 includes four support rods 286, connected at one end to frame support 276 and at the back end to rear frame 278, and mounted around air cylinder 254. The air cylinder 254 has an air inlet 258 and an air outlet 260. For the air inlet 258, the appropriate position is adjacent to rear frame assembly 278. Oppositely disposed is the air outlet 260 on air cylinder 254.

The cylinder shaft 268 is held in place by air cylinder support rods 286 and is slidably mounted in the air cylinder 254 and moved therein by air through inlet 258 and outlet 260. With cylinder shaft 268, is a following rod plate 262. The cylinder shaft 268 supports the following rod plate 262. The base rod plate 264 supports the cylinder shaft 268, which in turn contacts the piston assembly 240 and drive the caulking material out of the supply cylinder 130.

Within the frame assembly 180 assembly are two side supporting rods 280 and a base rod 284, which support the supply cylinder 130 in place. The reaction plate 272 includes a plate rod 282 extending to the base rod 284, which in turn extends from the frame support 276. In this fashion, the polyvinyl chloride pipe can be assembled as supply cylinder 130. The reaction plate 272, with its plate rod 282 and base rod 284, support the supply cylinder 130, which receives the piston assembly 240. The piston assembly 240, upon air activation forces caulk into supply cap 132.

The bleeder valve 148 is mounted on supply cap 132. The air pressure gage and four way air valve 202, permits the feeding of the caulk from one end and permits the valve to be withdrawn at the other end of tube or supply cylinder 130.

At the top of frame assembly 180 of the bulk load dispenser 100 are restraint bolts 190, which support reaction plate 272 on frame assembly 180. Reaction plate 272 includes hose slot 188 capable of receiving caulking hose 134 therethrough. Thus reaction plate 272 is in contact with supply cap 132.

Reaction plate 272 is positioned on frame assembly 180 by restraint bolts 190. Restraint bolts 190 pass through bolt apertures 192 in reaction plate 272 into threaded relation with restraint nuts 194. Each of the two restraint nuts 194 is secured to one of the side supporting rods 280 for frame assembly 180.

Piston assembly 240 is situated on the frame assembly 180 between side support rods 280 and front frame support 276. Piston assembly 240 includes preferably two of piston packing pads 242, plate bolts 244, top piston plate 246, base plate 250, and plate nuts 248.

The base plate rod 252 for piston assembly 240 is centrally located on base piston plate 250. Thus, base plate rod 252 is substantially centrally situated in supply cylinder 130 as piston assembly 240 passes therethrough and forces caulking compound (not shown) through caulking hose 134.

With the additional consideration of FIG. 5 and FIG. 6, valve assembly 120 is shown to include four-way valve 202 for controlling air flow to the bulk load dispenser 100. Four way valve 202 has four; connections reaching first air hose 204, second air hose 206, air supply hose 208, and exhaust hose 210. Air supply hose 214 connects air supply 170 to air pressure regulator 212. Regulated air hose 208 connects four-way valve 202 to regulator 212. Four valve 202 controls air flow direction to air cylinder 254. Exhaust hose 210 releases air form air cylinder 254, which is pushed out of air cylinder 254 internal driven direction. First air hose 204 joins first connection 212 and air inlet 258 (FIG. 4). Second air hose 206 joins air outlet 260 (FIG. 4) and second connection 214.

Regulator 212 and four-way valve 202 are mounted on utility belt 200 (FIG. 5). This enables the operator 102 to maneuver the device 100 more easily. Exhaust hose 208 connects four way air valve 202 to air pressure regulator 212. Air supply 170 is preferably a heavy duty compressor, although other air sources may be used.

With the addition of castors to frame assembly 180 as shown in FIG. 7, bulk load dispenser 100 becomes more mobile. A pair of reaction castors 308 are mounted on reaction plate 272. Further a pair of support castors 306 are mounted on frame assembly 180. Finally, a pair of frame castors 310 are mounted on rear frame 278. At least one pair of castors for castor assembly 300 make the bulk load dispenser 100 more mobile.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. A powered bulk load dispenser comprising:

(a) a frame supporting a tubular housing;

(b) a driving assembly being mounted at a first end of the tubular housing;

(c) an application hose being mounted at a second end of the tubular housing;

(d) the first end of the tubular housing being oppositely disposed from the second end of the tubular housing;

(e) a power source being operatively connected to the driving assembly; and (f) the reducing cap having a bleeder valve, in order to release pressure and facilitate loading of the powered bulk load dispenser.

2. The powered bulk load dispenser of claim 1, further comprising the tubular housing being polyvinyl chloride pipe.

3. The powered bulk load dispenser of claim 1, further comprising:

(a) a reducing cap being secured at the second end of the tubular housing; and (b) the application hose being secured to the reducing cap.

4. The powered bulk load dispenser of claim 3, further comprising:

(a) the reducing cap having an open end secured to the second end of the tubular housing;

(b) the reducing cap having a conical end oppositely disposed from the open end; and (c) the conical end having a nipple to receive the application hose.

5. The powered bulk load dispenser of claim 4, further comprising:

(a) a reaction plate removably securing the conical end and the application hose to the frame;

(b) the reducing cap including a bleeder valve, adapted to release pressure on the tubular housing for ease of disassembling and refilling;

(c) a driving assembly being mounted on the frame adjacent to the tubular housing and oppositely disposed from the reducing cap; and (d) the driving assembly including a piston assembly and a rod assembly.

6. The powered bulk load dispenser of claim 4, further comprising:

(a) a reaction plate removably securing the conical end and the application hose to the frame;

(b) a driving assembly being mounted on the frame adjacent to the tubular housing and oppositely disposed from the reducing cap; and (c) the driving assembly including a piston assembly and a rod assembly.

7. The powered bulk load dispenser of claim 6, further comprising:

(a) the piston assembly including a piston pad, a top plate, a bearing pad and a base piston plate;

(b) the piston pad being secured to the top plate;

(c) the top plate being secured to the bearing pad; and (d) the base plate being secured to the rod assembly.

8. The powered bulk load dispenser of claim 7, further comprising:

(a) the rod assembly including a following rod plate and a base rod plate;

(b) the base rod plate supporting the following rod plate; and (c) the following rod plate supporting the piston assembly and cooperating with an extending cylinder rod to contact the piston assembly in order to drive the piston assembly through the tube assembly and expel caulking material through the caulking hose.

9. The powered bulk load dispenser of claim 8, further comprising:

(a) the frame assembly including four supporting rods;

(b) the four supporting rods supporting the tube assembly in place;

(c) a reaction plate further supporting the tube assembly in place at a first end of the tube assembly;

(d) a central plate further supporting the tube assembly in place at a second end of the tube assembly; and (e) the reaction plate being oppositely disposed from the central plate.

10. The powered bulk load dispenser of claim 9, further comprising:

(a) an air supply assembly cooperating with the piston assembly;

(b) a base plate cooperating with the central plate to support the air supply assembly;

(c) a base rod extending from the base plate; and (d) the base rod providing an indication of a position for the piston assembly within the tube assembly.

11. The powered bulk load dispenser of claim 10, further comprising:

(a) a rod center for the piston assembly; and (b) the rod center aligning the piston assembly for moving through the tube assembly.

12. The powered bulk load dispenser of claim 11, further comprising:

(a) the air supply assembly including a control means for directing air to the piston assembly, a compressed air source and an air cylinder;

(b) the control means including a four way valve;

(c) the four way valve being connected to the compressed air source and the air cylinder; and (d) the four way valve directing air pressure to the air cylinder, thereby serving to drive the piston through the tube assembly.

13. The powered bulk load dispenser of claim 12, further comprising:

(a) the reducing cap including a bleeder valve operatively mounted thereon; and (b) the bleeder valve permitting pressure created by air supply to be released from the tube assembly and permit the reducing cap to be removed from the tube assembly.

14. The powered bulk load dispenser of claim 13, further comprising:

(a) the reducing cap including a bleeder valve mounted thereon; and (b) the bleeder valve serving relieve air pressure created in the tube assembly as desired.

15. The powered bulk load dispenser of claim 14, further comprising:

(a) the frame assembly further having a restraint and a carrying handle;

(b) the restraint supporting the tube assembly; and (c) the carrying handle permitting the bulk load dispenser to be transported easily.

16. The powered bulk load dispenser of claim 15, further comprising:

(a) a castor assembly being mounted on the frame assembly; and (b) the castor assembly having at least one pair of castors mounted on the fame assembly.

17. The powered bulk load dispenser of claim 16, further comprising a pneumatic power source.

* * * * *